US009381748B2

(12) United States Patent
Kimura et al.

(10) Patent No.: US 9,381,748 B2
(45) Date of Patent: Jul. 5, 2016

(54) LIQUID EJECTION DEVICE

(71) Applicant: Seiko Epson Corporation, Tokyo (JP)

(72) Inventors: Naomi Kimura, Okaya (JP); Shoma Kudo, Shiojiri (JP); Munehide Kanaya, Azumino (JP); Hidenao Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/227,642

(22) Filed: Mar. 27, 2014

(65) Prior Publication Data

US 2014/0292955 A1 Oct. 2, 2014

(30) Foreign Application Priority Data

Mar. 29, 2013 (JP) ..... 2013-071642

(51) Int. Cl.
*B41J 2/175* (2006.01)
*B41J 29/02* (2006.01)

(52) U.S. Cl.
CPC ..... *B41J 2/175* (2013.01); *B41J 2/1752* (2013.01); *B41J 29/02* (2013.01)

(58) Field of Classification Search
CPC ..... B41J 2/175; B41J 2/17509; B41J 2002/17516
See application file for complete search history.

(56) References Cited

U.S. PATENT DOCUMENTS

| | | | | |
|---|---|---|---|---|
| 4,967,207 | A * | 10/1990 | Ruder | 347/7 |
| 6,003,981 | A * | 12/1999 | Cameron et al. | 347/85 |
| 7,500,618 | B2 * | 3/2009 | Fujishiro et al. | 239/91 |
| 9,004,655 | B2 * | 4/2015 | Tamaki | B41J 2/1752 347/108 |
| 2008/0143764 | A1 * | 6/2008 | Kaga et al. | 347/7 |
| 2012/0038719 | A1 | 2/2012 | Shimizu et al. | |

FOREIGN PATENT DOCUMENTS

| | | | |
|---|---|---|---|
| JP | 2000-153619 | A | 6/2000 |
| JP | 2003-326732 | A | 11/2003 |
| WO | 2011/129123 | A2 | 10/2011 |

* cited by examiner

*Primary Examiner* — Geoffrey Mruk
(74) *Attorney, Agent, or Firm* — Nutter McClennen & Fish LLP; John J. Penny, Jr.

(57) ABSTRACT

A liquid ejection device provided by the invention can be easily transported in a stable orientation in which the weight balance is kept. A printer of the invention includes a liquid ejection head for ejecting ink onto a sheet, ink tanks for storing ink to be supplied to the liquid ejection head, and tubes that connect the ink tanks to the liquid ejection head. An ink injection opening that enables the injection of ink is formed on the upper side of the ink tanks in the vertical direction, and one portion of the ink tanks and another portion of the ink tanks are respectively arranged on one side and another side that face each other across a sheet conveying region.

26 Claims, 2 Drawing Sheets

LIQUID EJECTION DEVICE

BACKGROUND

1. Technical Field

The present invention relates to a liquid ejection device that includes a liquid storage portion that can store a liquid that is to be ejected from a liquid ejection portion.

2. Related Art

One type of heretofore-known liquid ejection device is an inkjet printer that includes ink tanks (liquid storage portions) that can store ink (a liquid) that is to be ejected from a liquid ejection head (liquid ejection portion) toward a medium (e.g., see WO-2011/129123 and JP-A-2000-153619).

With this printer, multiple ink tanks that can store various colors of ink are mounted to the outside of the casing that constitutes the exterior of the printer. These ink tanks are mounted close together on only one of two sides that face each other across the medium conveying region in the casing. This has caused a problem in that since the center of gravity of the printer is biased toward one of the two sides that face each other across the medium conveying region in the casing, it is difficult to transport the printer in a stable orientation in which the weight balance is kept.

Note that generally the same issue arises in the case where the ink tanks are stored inside the casing as well, since if all of the ink tanks are arranged close together in the casing, the center of gravity of the printer is biased toward one of the two sides that face each other across the medium conveying region in the casing.

Also, generally the same issue arises in liquid ejection devices that include a liquid storage portion that can store a liquid that is to be ejected from a liquid ejection portion

SUMMARY

An advantage of some aspects of the invention is providing a liquid ejection device that can be easily transported in a stable orientation in which the weight balance is kept.

According to a first aspect of the invention, A liquid ejection device includes: a liquid ejection portion that ejects a liquid onto a medium; a liquid storage portion that stores the liquid to be supplied to the liquid ejection portion; and a flow channel that connects the liquid storage portion and the liquid ejection portion, wherein the liquid storage portion is configured so as to include a first liquid storage portion and a second liquid storage portion, a liquid injection opening that enables injection of the liquid being formed on an upper side of the first liquid storage portion and the second liquid storage portion in the vertical direction, and the first liquid storage portion and the second liquid storage portion are respectively arranged on one side and another side that face each other across a medium conveying region.

According to the above configuration, the first liquid storage portion and the second liquid storage portion are arranged in a distributed manner on two sides that face each other across the medium conveying region. This suppresses the center of gravity of the liquid ejection device from being biased toward one of the two sides that face each other across the medium conveying region, thus making it possible to easily transport the liquid ejection device in a stable orientation in which the weight balance is kept.

In the above liquid ejection device, it is preferable that a liquid storing capacity of the first liquid storage portion is greater than that of the second liquid storage portion.

According to the above configuration, the first liquid storage portion and the second liquid storage portion are arranged in a distributed manner on two sides that face each other across the medium conveying region, thus making it possible to increase the capacity of the first liquid storage portion while suppressing this from having an influence on the space occupied by the second liquid storage portion.

In the above liquid ejection device, the liquid storage portion may be configured so as to include a plurality of the second liquid storage portions, and the plurality of second liquid storage portions may be arranged side-by-side in a medium conveying direction.

According to the above configuration, the first liquid storage portion having a relatively large capacity is arranged on one side located across the medium conveying region, and multiple second liquid storage portions having a relatively small capacity are arranged on the other side located across the medium conveying region. This further suppresses the center of gravity of the liquid ejection device from being biased toward one of the two sides that face each other across the medium conveying region, thus making it possible to even more easily transport the liquid ejection device in a stable orientation in which the weight balance is kept. Also, since the second liquid storage portions are arranged side-by-side in the medium conveying direction, it is possible to suppress an increase in the horizontal width of the liquid ejection device in a view in a direction conforming to the medium conveying direction.

In the above liquid ejection device, it is preferable that the liquid storage portion is configured so as to include a plurality of the second liquid storage portions, and the plurality of second liquid storage portions are arranged side-by-side in a direction orthogonal to a medium conveying direction.

According to the above configuration, the second liquid storage portions are arranged side-by-side in a direction orthogonal to the medium conveying direction. For this reason, a liquid can be easily injected into the second liquid storage portions through the liquid injection openings from the side of the liquid ejection device that has a medium discharge opening. In particular, in the case where media is discharged from the front face side of the liquid ejection device, a liquid can be easily injected into the second liquid storage portions from the front face side of the liquid ejection device.

In the above liquid ejection device, it is preferable that the first liquid storage portion is arranged such that a lengthwise direction thereof conforms to a medium conveying direction, the liquid storage portion is configured so as to include a plurality of the second liquid storage portions, and among the plurality of second liquid storage portions, a portion of the second liquid storage portions are arranged between the medium conveying region and the first liquid storage portion on the one side located across the medium conveying region, and at least another portion of the second liquid storage portions are arranged on the other side located across the medium conveying region.

According to the above configuration, multiple second liquid storage portions are arranged in a distributed manner on the two sides that face each other across the medium conveying region. For this reason, even if the number of second liquid storage portions is increased, it is possible to ensure sufficient occupation space for the increased number of second liquid storage portions, in comparison with the case where the second liquid storage portions are arranged on only one of the two sides that face each other across the medium conveying region. This enables ensuring a sufficient size for the liquid injection openings of the second liquid storage portions, thus making it possible to easily inject a liquid into the second liquid storage portions through the liquid injection openings. Also, since the first liquid storage portion is arranged such that its lengthwise direction conforms to the medium conveying direction, it is possible to suppress an increase in the horizontal width of the liquid ejection device in a view in a direction conforming to the medium conveying direction.

In the above liquid ejection device, it is preferable that the plurality of second liquid storage portions are provided with a viewing portion that enables viewing of a state of the ink inside the second liquid storage portions on a side face that extends along an alignment direction of the second liquid storage portions.

According to the above configuration, the condition of the injection of a liquid into the second liquid storage portions can be viewed through the viewing portion from one direction, thus making it possible to easily perform the operation of injecting a liquid into the second liquid storage portions. Also, in the case where the second liquid storage portions are arranged side-by-side in a direction orthogonal to the medium conveying direction, and the viewing portion is provided on the side face that extends along the alignment direction of the second liquid storage portions, the extent of consumption of the liquid in the second liquid storage portions can be checked at a glance through the viewing portion from the side of the liquid ejection device that has the medium discharge opening. In particular, in the case where media is discharged from the front face side of the liquid ejection device, the extent of consumption of the liquid in the second liquid storage portions can be checked at a glance through the viewing portion from the front face side of the liquid ejection device.

In the above liquid ejection device, it is preferable that the first liquid storage portion is provided with a viewing portion that enables viewing of a state of the ink inside the first liquid storage portion on a side face that has a largest area among outward-facing side faces.

According to the above configuration, a sufficient size can be ensured for the viewing portion of the first liquid storage portion. This enables the condition of the injection of a liquid into the first liquid storage portion to be easily checked through the viewing portion, thus making it possible to easily perform the operation of injecting a liquid into the first liquid storage portion.

In the above liquid ejection device, it is preferable that a cross-sectional area of the flow channel connected to the first liquid storage portion is larger than a cross-sectional area of the flow channel connected to the second liquid storage portion.

According to the above configuration, the cross-sectional area of the flow channel connected to the first liquid storage portion, which is for storing an often-used liquid, is relatively large. This reduces the flow channel resistance when the often-used liquid flows from the first liquid storage portion to liquid ejection portion, thus making it possible to smoothly supply that liquid to the liquid ejection portion.

In the above liquid ejection device, it is preferable that a valve unit for opening and closing the flow channel is arranged on a side face of the liquid storage portion that faces a medium conveying direction.

According to the above configuration, the valve unit for opening and closing the flow channel connected to the liquid storage portion is arranged on the side of the liquid ejection device that has the medium discharge opening, thus making it possible to easily operate the valve unit. In particular, in the case where media is discharged from the front face side of the liquid ejection device, the valve unit can be easily operated from the front face side of the liquid ejection device.

In the above liquid ejection device, it is preferable that the first liquid storage portion stores black ink as the liquid, and the second liquid storage portion stores a color of ink other than black as the liquid.

According to the above configuration, the first liquid storage portion for storing black ink and the second liquid storage portion for storing another color of ink are respectively arranged on the one side and the other side that face each other across the medium conveying region. This suppresses the center of gravity of the liquid ejection device from being biased toward one of the two sides that face each other across the medium conveying region, thus making it possible to easily transport the liquid ejection device in a stable orientation in which the weight balance is kept. Also, the second liquid storage portion for storing a color of ink other than black is arranged on the side opposite to the first liquid storage portion for storing black ink across the medium conveying region, and therefore even if the capacity of the first liquid storage portion for storing often-used black ink is increased, the space occupied by the second liquid storage portion is not likely to decrease. This enables ensuring a sufficient size for the liquid injection opening of the second liquid storage portion, thus making it possible to easily perform the operation of injecting a liquid into the second liquid storage portion.

In the above liquid ejection device, it is preferable that the liquid storage portion is provided inside a casing that constitutes the exterior of the liquid ejection device.

According to the above configuration, the first liquid storage portion and the second liquid storage portion are arranged in a distributed manner so as to be respectively located on two sides that face each other across the medium conveying region in the casing. For this reason, even if the capacity of the first liquid storage portion is set higher than the capacity of the second liquid storage portion in the limited space inside the casing, the space occupied by the second liquid storage portion in the casing is not likely to decrease. This enables ensuring a sufficient size for the liquid injection opening of the second liquid storage portion, thus making it possible to easily perform the operation of injecting a liquid into the second liquid storage portion.

DESCRIPTION OF EXEMPLARY EMBODIMENTS

First Embodiment

A first embodiment in which a liquid ejection device is embodied as an inkjet printer will be described below with reference to the drawings.

Figure 1:
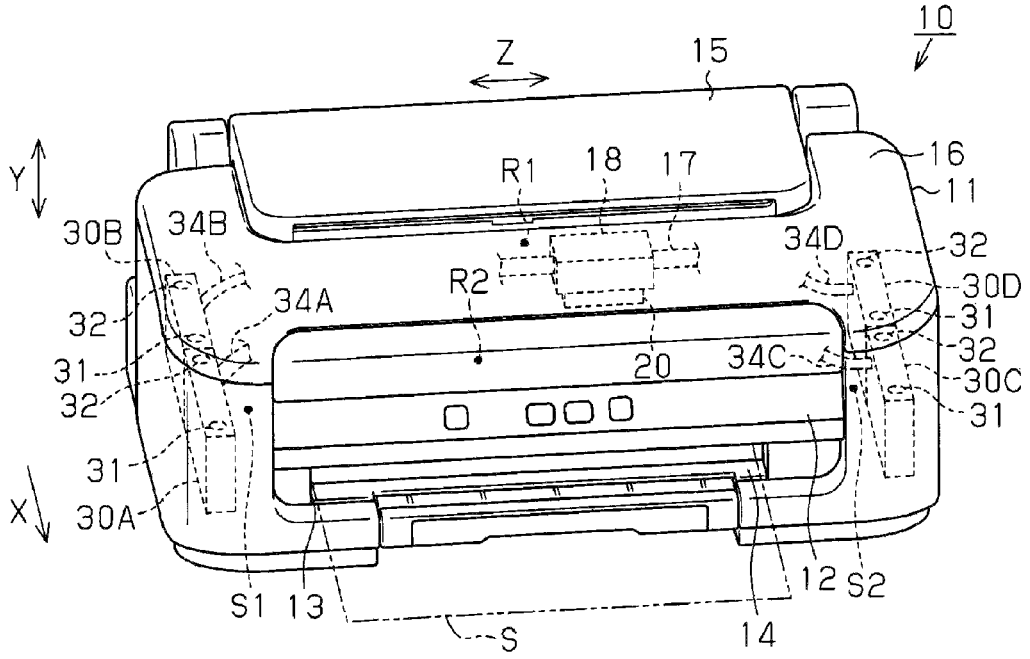
FIG. 1 is a perspective view of a printer according to a first embodiment.

As shown in FIG. 1, a casing 11 that constitutes the exterior of a printer 10 of this embodiment is substantially parallelepiped-shaped, and an operation panel 12 for performing various types of operations on the printer 10 is arranged on one side face of the casing 11. Also, a discharge opening 13 is formed below the operation panel 12 on the one side face of the casing 11. Furthermore, an extendable paper discharge tray 14 is accommodated below the discharge opening 13 in the casing 11.

Note that in this embodiment, the one side face of the casing 11 that is provided with the discharge opening 13 is considered to be the front face of the printer 10, the side face on the opposite side is considered to be the rear face, and the direction from the rear side to the front side is illustrated as a conveying direction X. Also, the gravity direction orthogonal to the conveying direction X is considered to be the downward direction, the counter-gravity direction is considered to be the upward direction, and the direction along the upward direction and the downward direction is illustrated as an up-down direction Y. Furthermore, the direction orthogonal to the conveying direction X and the up-down direction Y is illustrated as a main scanning direction Z.

A pivoting paper feed tray 15 and a lid portion 16 that is opened and closed when performing maintenance or the like in the casing 11 are attached to the rear portion of the upper side of the casing 11 so as to be able to be opened and closed. Also, a guide shaft 17 that extends along the main scanning direction Z, which is the lengthwise direction of the casing 11, is provided in the casing 11. Furthermore, a carriage 18 is supported to the guide shaft 17 so as to be able to move along the main scanning direction Z. The carriage 18 moves back and forth along the main scanning direction Z in accordance with the driving of a carriage motor (not shown).

A liquid ejection head 20 is supported to the lower face side of the carriage 18 as an example of the liquid ejection portion for ejecting ink, which is one example of a liquid, onto a sheet S, which is one example of a medium. Printing is performed on the sheet S by ejecting ink onto the sheet S with the liquid ejection head 20 as it moves integrally with the carriage 18.

Note that the casing 11 is provided so as to surround the traveling region of the carriage 18 that extends along the main scanning direction Z. Also, a portion of the traveling region that excludes the two end sides in the main scanning direction Z and is in the vicinity of the center is a printing region R1 where printing is performed on the sheet S. A mechanism (not shown) for performing maintenance on the liquid ejection head 20 and a mechanism (not shown) for receiving ink from the liquid ejection head 20 during dummy discharge are respectively arranged on one side and another side that face each other across the printing region R1 in the main scanning direction Z in the casing 11.

Also, a conveying region R2 where the sheet S that has been subjected to printing in the printing region R1 is located downstream of the printing region R1 in terms of the sheet S conveying direction X in the casing 11. Also, a first space S1 and a second space S2 are respectively formed as dead spaces at locations corresponding to one side (the left side in FIG. 1) and another side (the right side in FIG. 1) that face each other across the conveying region R2 in the main scanning direction Z in the casing 11.

Ink tanks 30A, 30B, 30C, and 30D, which are examples of liquid storage portions that are parallelepiped-shaped and store various colors of ink (in this embodiment, black ink (K), cyan ink (C), magenta ink (M), and yellow ink (Y)), are arranged in the spaces S1 and S2. Specifically, the ink tank 30A, which is an example of a first liquid storage portion for storing black ink, and the ink tank 30B, which is an example of a second liquid storage portion for storing cyan ink, are arranged in the first space S1 side-by-side in the depth direction of the casing 11, which conforms to the sheet S conveying direction X. On the other hand, the ink tank 30C and the ink tank 30D, which are examples of second liquid storage portions for storing magenta ink and yellow ink respectively, are arranged in the second space S2 side-by-side in the depth direction of the casing 11, which conforms to the sheet S conveying direction X.

In other words, the ink tank 30A serving as an example of the first liquid storage portion is arranged on one side located across the conveying region R2 in the main scanning direction Z in the casing 11. Also, among the ink tanks 30B to 30D serving as examples of second liquid storage portions, the one ink tank 30B is also arranged on the one side located across the conveying region R2 in the main scanning direction Z in the casing 11. On the other hand, among the ink tanks 30B to 30D serving as examples of second liquid storage portions, both of the other ink tanks 30C and 30D are arranged on the other side located across the conveying region R2 in the main scanning direction Z in the casing 11.

An ink injection opening 31, which is an example of a liquid injection opening that enables ink to be injected into the ink tanks 30A to 30D, and an atmosphere communication opening 32 for communication with the atmosphere so as to allow air to be taken into the ink tanks 30A to 30D are formed in the upper face of each of the ink tanks 30A to 30D. Note that the ink tanks 30A to 30D are arranged such that their lengthwise direction conforms to the depth direction of the casing 11 and such that their thickness direction conforms to the main scanning direction Z. Also, the lengthwise-direction dimension of the ink tank 30A for storing black ink is greater than the lengthwise-direction dimension of the ink tanks 30B to 30D for storing the other colors of ink. For this reason, the volume of the ink tank 30A for storing black ink is greater than the volume of the ink tanks 30B to 30D for storing the other colors of ink.

Also, the ink stored in the ink tanks 30A to 30D is supplied to the liquid ejection head 20 via tubes 34A, 34B, 34C, and 34D, which are examples of flexible flow channels. In this case, the diameter of the tube 34A connected to the ink tank 30A for storing black ink is greater than the diameter of the tubes 34B to 34D connected to the ink tanks 30B to 30D for storing the colors of ink other than black. For this reason, the flow channel cross-sectional area of the tube 34A connected to the ink tank 30A for storing black ink is greater than the flow channel cross-sectional area of the tubes 34B to 34D connected to the ink tanks 30B to 30D for storing the colors of ink other than black.

Next, operations of the printer 10 having the above-described configuration will be described.

In this embodiment, among the ink tanks 30A to 30D for storing various colors of ink, the ink tanks 30A and 30B and the ink tanks 30C and 30D are arranged in a distributed manner so as to be respectively located in the first space S1 and the second space S2, which are located on the two sides that face each other across the conveying region R2 in the main scanning direction Z in the casing 11. This suppresses the position of the center of gravity of the printer 10 from being biased toward one side in the main scanning direction Z due to the weight of the ink tanks 30A to 30D, in comparison with the case where all of the ink tanks 30A to 30D are arranged in only either the first space S1 or the second space S2 in the casing 11. Therefore, by aligning the lengthwise direction of the casing 11 with the horizontal direction, it is possible to easily transport the printer 10 in a stable orientation in which the weight balance is kept.

Also, in this embodiment, the ink tanks 30A and 30B and the ink tanks 30C and 30D are arranged in a distributed manner so as to be respectively located in the first space S1 and the second space S2 formed as dead space in the casing 11. For this reason, the ink tanks 30A to 30D are efficiently arranged in the limited space inside the casing 11, in comparison with the case where all of the ink tanks 30A to 30D are arranged in only either the first space S1 or the second space S2 in the casing 11. As a result, sufficient installation space for the ink tanks 30A to 30D in the casing 11 is ensured without increasing the size of the casing 11. The size of the ink tanks 30A to 30D is therefore not likely to be constrained, and a sufficient size is thus ensured for the ink injection openings 31 of the ink tanks 30A to 30D.

The above-described first embodiment can obtain effects such as those described below.

(1) The ink tanks 30A and 30B and the ink tanks 30C and 30D are arranged in a distributed manner so as to respectively be located on two sides that face each other across the sheet S conveying region R2. This suppresses the center of gravity of the printer 10 from being biased to one of the two sides that face each other across the sheet S conveying region R2, thus making it possible to easily transport the printer 10 in a stable orientation in which the weight balance is kept. Also, it is possible to increase the capacity of the ink tank 30A while suppressing this from having an influence on the space occupied by the ink tanks 30C and 30D.

(2) The ink tank 30A having a relatively large capacity is arranged on one side located across the sheet S conveying region R2, and the ink tanks 30C and 30D having a relatively small capacity are arranged on the other side located across the sheet S conveying region R2. This further suppresses the center of gravity of the printer 10 from being biased to one of the two sides that face each other across the sheet S conveying region R2, thus making it possible to more easily transport the printer 10 in a stable orientation in which the weight balance is kept.

(3) The ink tanks 30A to 30D are arranged side-by-side in the sheet S conveying direction X, thus making it possible to suppress an increase in the horizontal width of the printer 10 in a view from the front of the printer 10 in a direction conforming to the sheet S conveying direction X.

(4) The ink tank 30B and the ink tanks 30C and 30D for storing the colors of ink other than black are arranged in a distributed manner so as to be respectively located on the two sides that face each other across the sheet S conveying region R2. For this reason, even if the number of ink tanks 30B to 30D for storing the colors of ink other than black is increased, it is possible to ensure sufficient occupation space for the increased number of ink tanks 30B to 30D, in comparison with the case where the ink tanks 30B to 30D are arranged on only one of the two sides that face each other across the sheet S conveying region R2. This enables ensuring a sufficient size for the ink injection openings 31 of the ink tanks 30B to 30D, thus making it possible to easily inject ink into the ink tanks 30B to 30D through the ink injection openings 31.

(5) The ink tank 30A is arranged such that its lengthwise direction conforms to the sheet S conveying direction X. This enables suppressing an increase in the horizontal width of the printer 10 in a view from the front of the printer 10 in a direction conforming to the sheet S conveying direction.

(6) The flow channel cross-sectional area of the tube 34A connected to the ink tank 30A for storing the often-used black ink is greater than the flow channel cross-sectional area of the tubes 34B to 34D connected to the ink tanks 30B to 30D for storing the colors of ink other than black. This reduces the flow channel resistance when the often-used black ink flows through the tube 34A from the ink tank 30A to the liquid ejection head 20, thus making it possible to smoothly supply black ink to the liquid ejection head 20.

(7) The ink tanks 30A and 30B and the ink tanks 30C and 30D are arranged in a distributed manner on the two sides that face each other across the sheet S conveying region R2 in the casing 11. For this reason, even if the capacity of the ink tank 30A is set higher than the capacity of the ink tanks 30C and 30D in the limited space inside the casing 11, the space occupied by the ink tanks 30C and 30D in the casing 11 is not likely to decrease. This enables ensuring a sufficient size for the ink injection openings 31 of the ink tanks 30C and 30D, thus making it possible to easily perform the operation of injecting ink into the ink tanks 30C and 30D.

Second Embodiment

A second embodiment will be described below. Note that the second embodiment differs from the first embodiment in that the ink tanks 30A to 30D are arranged side-by-side in the main scanning direction Z. For this reason, the following description focuses on configurations that are different from the first embodiment, the same reference signs have been given to configurations that are the same as or correspond to configurations in the first embodiment, and redundant descriptions will not be given for such configurations.

Figure 2:
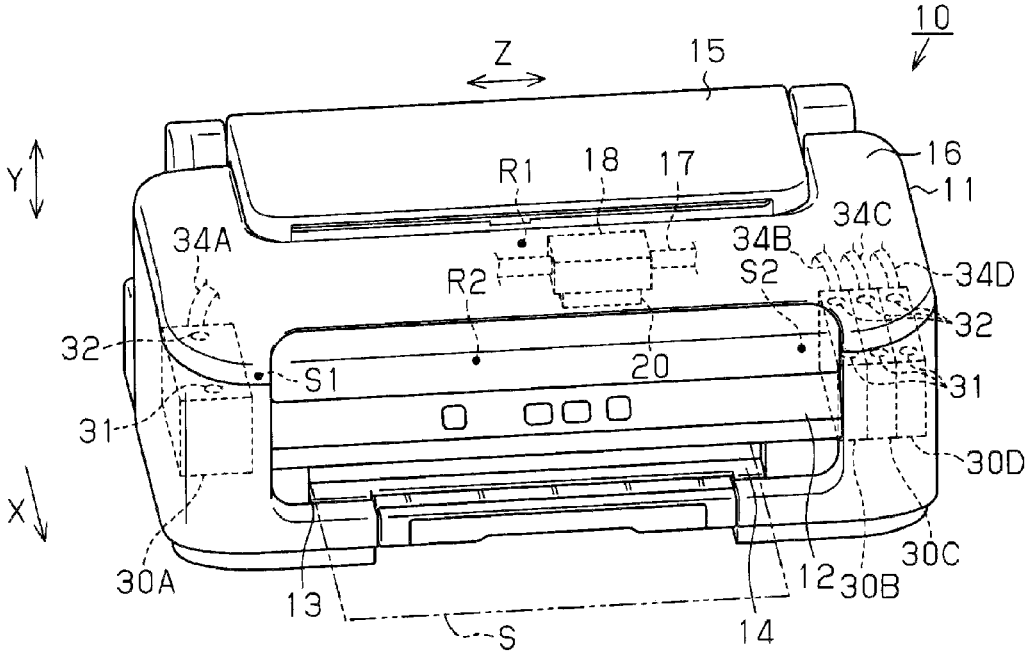
FIG. 2 is a perspective view of a printer according to a second embodiment.

As shown in FIG. 2, the ink tanks 30A to 30D for storing various colors of ink are arranged side-by-side in the main scanning direction Z, which is the lengthwise direction of the casing 11, in the spaces S1 and S2 in the casing 11. Specifically, the ink tank 30A for storing black ink is arranged in the first space S1. The ink tank 30B, the ink tank 30C, and the ink tank 30D for respectively storing cyan ink, magenta ink, and yellow ink are arranged in the main scanning direction Z in the second space S2, in the stated order beginning from the conveying region R2 side. In other words, the ink tanks 30B to 30D, which are examples of second liquid storage portions, are arranged on the side of the casing 11 that is opposite to the ink tank 30A across the sheet S conveying region R2.

Note that the ink tanks 30A to 30D are arranged such that their lengthwise direction conforms to the depth direction of the casing 11 and such that their thickness direction conforms to the main scanning direction Z. Also, the thickness-direction dimension of the ink tank 30A for storing black ink is greater than the thickness-direction dimension of the ink tanks 30B to 30D for storing the other colors of ink. For this reason, the volume of the ink tank 30A for storing black ink is greater than the volume of the ink tanks 30B to 30D for storing the other colors of ink.

The above-described second embodiment can obtain effects such as that described below in addition to the effects (1), (2), and (4) to (7) of the first embodiment.

(8) The ink tanks 30A to 30D are arranged side-by-side in a direction orthogonal to the sheet S conveying direction. For this reason, ink can be easily injected into the ink tanks 30A to 30D through the ink injection openings 31 from the front side of the printer 10, which is the side of the printer 10 that has the sheet S discharge opening 13.

Third Embodiment

A third embodiment will be described below. Note that the third embodiment differs from the first embodiment in that the ink tanks 30A to 30D are mounted to the outside of the casing 11. For this reason, the following description focuses on configurations that are different from the first embodiment, the same reference signs have been given to configurations that are the same as or correspond to configurations in the first embodiment, and redundant descriptions will not be given for such configurations.

Figure 3:
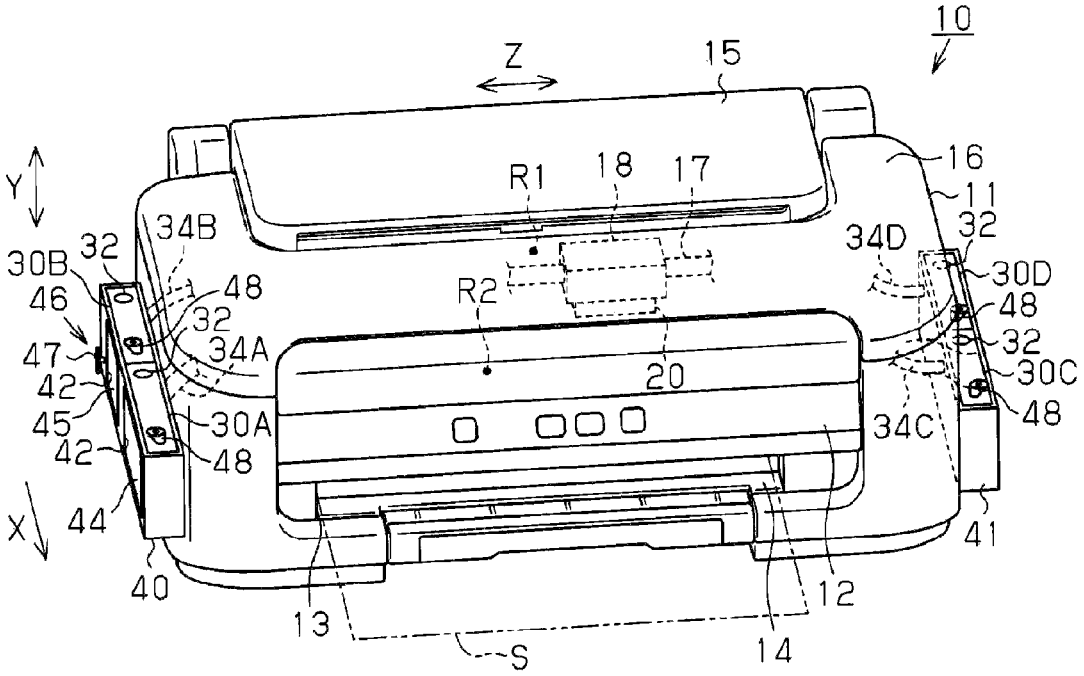
FIG. 3 is a perspective view of a printer according to a third embodiment.

As shown in FIG. 3, a tank case 40 and a tank case 41 that are box-shaped with an open upper side are fixed to outer side faces respectively on one side (the left side in FIG. 3) and another side (the right side in FIG. 3) in the main scanning direction Z in the casing 11.

The ink tank 30A and the ink tank 30B for respectively storing black ink and cyan ink are mounted in the tank case 40 side-by-side in the depth direction of the casing 11, which conforms to the sheet S conveying direction X. Also, rectangular window portions 42 that put the inside and outside of the tank case 40 in communication are formed on the outer side face of the tank case 40 that extends along the alignment direction of the ink tanks 30A and 30B. These window portions 42 are formed at two locations on the outer side face of the tank case 40 that are separated by a distance in the alignment direction of the ink tanks 30A and 30B, so as to respectively correspond to the ink tank 30A and the ink tank 30B.

On the other hand, the ink tank 30C and the ink tank 30D for respectively storing magenta ink and yellow ink are mounted in the tank case 41 side-by-side in the depth direction of the casing 11, which is the sheet S conveying direction X. Also, rectangular window portions (not shown) that put the inside and outside of the tank case 41 in communication are formed on the outer side face of the tank case 41 that extends along the alignment direction of the ink tanks 30C and 30D. These window portions are formed at two locations on the outer side face of the tank case 41 that are separated by a distance in the alignment direction of the ink tanks 30C and 30D, so as to respectively correspond to the ink tank 30C and the ink tank 30D.

Note that the ink tanks 30A to 30D are mounted in the tank cases 40 and 41 such that their lengthwise direction conforms to the depth direction of the casing 11 and such that their thickness direction conforms to the main scanning direction Z. Also, the ink tanks 30A to 30D are constituted using transparent or translucent resin. This makes it possible for the state of the ink stored in the ink tanks 30A to 30D mounted in the tank cases 40 and 41 to be viewed from outside the casing 11 through the window portions 42 in the tank cases 40 and 41. Specifically, the state of the ink inside the ink tank 30A, which is an example of the first liquid storage portion, can be viewed through a side face 44, which is an example of a viewing portion that extends along the depth direction of the casing 11 and has the largest area among the outward-facing side faces. Also, the state of the ink inside the ink tanks 30B to 30D, which are examples of second liquid storage portions, can be viewed through a side face 45 (only the side face of the ink tank 30B is shown in FIG. 3), which is an example of a viewing portion that extends along the alignment direction of these ink tanks, that is to say along the depth direction of the casing 11.

Also, a valve unit 46 is provided in a lower corner portion of each of the tank cases 40 and 41 on the outer side faces extending along the depth direction of the casing 11, specifically in a portion in which the window portion 42 is not formed (only the valve unit provided on the tank case 40 is shown in FIG. 3). The valve units 46 make it possible to switch the state of the flow of ink from the ink tanks 30A to 30D to the liquid ejection head 20 through the tubes 34A to 34D by opening and closing the tubes 34A to 34D in accordance with a manual operation performed on a valve lever 47.

Also, a tube portion 48 is formed on the upper face of each of the ink tanks 30A to 30D, and the openings at the upper ends of these tube portions 48 are connected to the corresponding ink injection openings 31. The tube portions 48 are funnel-shaped such that the area of the opening gradually increases from the lower end to the upper end. Specifically, an outer peripheral portion of the tube portion 48 on the casing 11 side extends vertically in the up-down direction Y, whereas an outer peripheral portion of the tube portion 48 on the side opposite to the casing 11 is inclined so as to move away from the outer side face of the casing 11, from its lower end to its upper end. The ink injection opening 31 formed at the upper end of the tube portion 48 is therefore provided at a greater distance from the outer side face of the casing 11 in the main scanning direction Z in comparison with the case where the tube portion 48 is not formed on the upper faces of the ink tanks 30A to 30D and the case where the tube portion 48 extends linearly in the up-down direction Y.

In this embodiment, the ink tanks 30A to 30D for storing various colors of ink are mounted in a distributed manner in the tank cases 40 and 41 that are respectively fixed to the outer side faces on the two sides in the main scanning direction Z in the casing 11. This suppresses the position of the center of gravity of the printer 10 from being biased toward one of the two sides that face each other in the main scanning direction Z due to the weight of the ink tanks 30A to 30D, in comparison with the case where all of the ink tanks 30A to 30D are mounted in only a tank case that is fixed to an outer side face of the casing 11 on one side in the main scanning direction Z. Therefore, by aligning the lengthwise direction of the casing 11 with the horizontal direction, it is possible to easily transport the printer 10 in a stable orientation in which the weight balance is kept.

Also, in this embodiment, the ink tanks 30A to 30D are efficiently mounted to the outer side faces of the casing 11 that are limited in terms of the dimension in the depth direction of the casing 11, in comparison with the case where all of the ink tanks 30A to 30D are mounted in only a tank case that is fixed to an outer side face of the casing 11 on one side in the main scanning direction Z. As a result, sufficient space for mounting the ink tanks 30A to 30D to the casing 11 is ensured without increasing the size of the casing 11. The size of the ink tanks 30A to 30D is therefore not likely to be constrained, and a sufficient size is thus ensured for the ink injection openings 31 of the ink tanks 30A to 30D.

The above-described third embodiment can obtain effects such as those described below in addition to the effects (1) to (6) of the first embodiment.

(9) The state of the ink inside the ink tanks 30C and 30D can be viewed through the side face that extends along the alignment direction of the ink tanks 30C and 30D. This enables the condition of the injection of ink into the ink tanks 30C and 30D to be viewed from one direction, thus making it possible to easily perform the operation of injecting ink into the ink tanks 30C and 30D.

(10) The state of the ink inside the ink tank 30A can be viewed through the side face 44 that has the largest area among the outward-facing side faces. This makes it possible to ensure a sufficient size for the side face 44 that is to be a viewing portion for the ink tank 30A. It is therefore possible to easily view the condition of the injection of ink into the ink tank 30A, thus making it possible to easily perform the operation of injecting ink into the ink tank 30A.

Fourth Embodiment

A fourth embodiment will be described below. Note that the fourth embodiment differs from the third embodiment in that the ink tanks 30A to 30D are arranged side-by-side in the main scanning direction Z. For this reason, the following description focuses on configurations that are different from the third embodiment, the same reference signs have been given to configurations that are the same as or correspond to configurations in the third embodiment, and redundant descriptions will not be given for such configurations.

Figure 4:
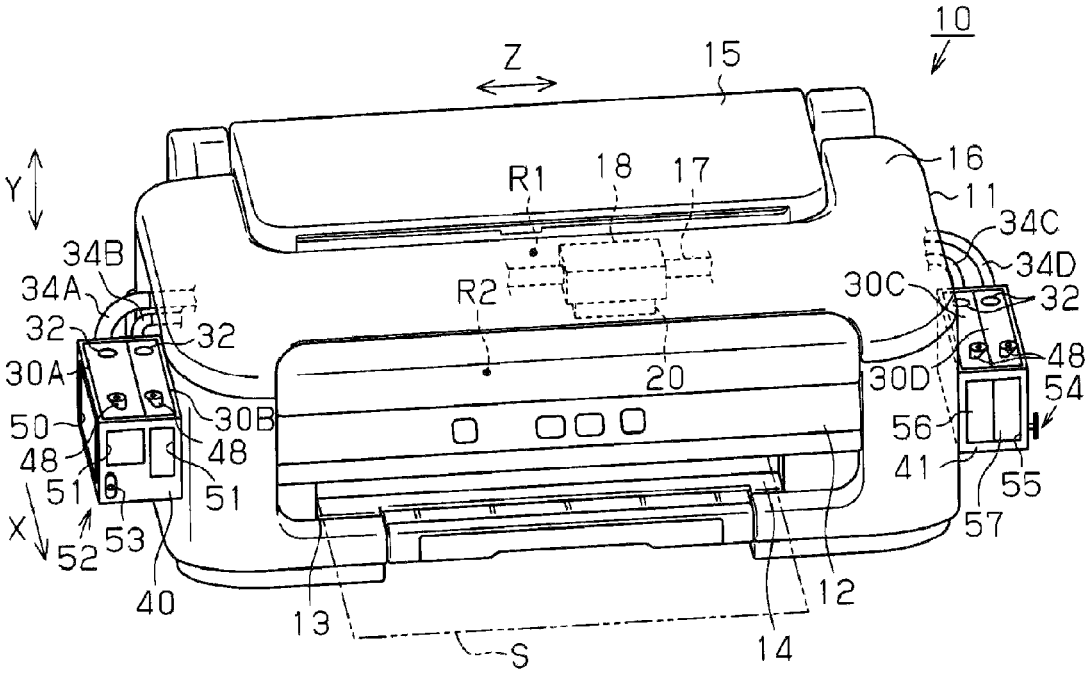
FIG. 4 is a perspective view of a printer according to a fourth embodiment.

As shown in FIG. 4, the ink tank 30B and the ink tank 30A for respectively storing cyan ink and black ink are mounted in the tank case 40 side-by-side in the main scanning direction Z in the stated order beginning from the casing 11 side. Also, a rectangular window portion 50 that puts the inside and outside of the tank case 40 in communication is formed on the outer side face of the tank case 40 that extends along the depth direction of the casing 11. The window portion 50 is open over substantially the entire region of the outer side face of the tank case 40.

Also, rectangular window portions 51 that put the inside and outside of the tank case 40 in communication are formed on the front face of the tank case 40, which is one of the outer side faces of the tank case 40 that extend along the alignment direction of the ink tanks 30A and 30B. These window portions 51 are formed at two locations on the front face of the tank case 40 that are separated by a distance in the main scanning direction Z, so as to respectively correspond to the ink tank 30A and the ink tank 30B.

A valve unit 52 is provided in a lower corner portion of the front face of the tank case 40 on the side opposite to the casing 11 in the main scanning direction Z. Specifically, the valve unit 52 is arranged on the front face of the tank case 40, which is the side face that faces the sheet S conveying direction X. Also, a valve lever 53 of the valve unit 52 is provided in a portion of the front face of the tank case 40 on the side near the ink tank 30A.

On the other hand, the ink tank 30C and the ink tank 30D for respectively storing magenta ink and yellow ink are mounted in the tank case 41 side-by-side in the main scanning direction Z in the stated order beginning on the casing 11 side. Also, a rectangular window portion (not shown) for putting the inside and outside of the tank case 41 in communication is formed on the outer side face of the tank case 41 that extends along the depth direction of the casing 11. This window portion is open over substantially the entire region of the outer side face of the tank case 41. Also, a valve unit 54 is provided in a lower corner portion where the window portion is not formed on the outer side face of the tank case 41.

Also, a rectangular window portion 55 that puts the inside and outside of the tank case 41 in communication is formed on the front face of the tank case 41, which is one of the outer side faces of the tank case 41 that extend along the alignment direction of the ink tanks 30C and 30D. The window portion 55 is open over substantially the entire region of the front face of the tank case 41. This makes it possible for the state of the ink stored in both of the ink tanks 30C and 30D mounted in the tank case 41 to be viewed from outside the casing 11 through the window portion 55 in the tank case 41. Specifically, the state of the ink inside the ink tanks 30C and 30D, which are examples of second liquid storage portions, can be viewed through front faces 56 and 57, which are examples of viewing portions that extend along the alignment direction of the ink tanks 30C and 30D.

Note that the ink tanks 30A to 30D are mounted in the tank cases 40 and 41 such that their lengthwise direction conforms to the depth direction of the casing 11 and such that their thickness direction conforms to the main scanning direction Z. Also, the thickness-direction dimension of the ink tank 30A for storing black ink is greater than the thickness-direction dimension of the ink tanks 30B to 30D for storing the other colors of ink. For this reason, the volume of the ink tank 30A for storing black ink is greater than the volume of the ink tanks 30B to 30D for storing the other colors of ink.

The above-described fourth embodiment can obtain effects such as those described below in addition to the effects (1), (2), (4) to (6), and (8) to (10) of the above-described embodiments.

(11) The ink tanks 30C and 30D are arranged side-by-side in a direction orthogonal to the sheet S conveying direction X, and it is possible to view the state of the ink inside them through the front faces 56 and 57 that extend along the alignment direction of the ink tanks 30C and 30D. For this reason, the state of the ink inside the two ink tanks 30C and 30D can be checked at a glance from the front face side of the printer 10, which is the side of the printer 10 that has the sheet S discharge opening 13.

(12) The valve unit 52 is arranged on the front face of the tank case 40 that faces the sheet S conveying direction X. For this reason, the valve unit 52 for opening and closing the tubes 34A and 34B connected to the ink tanks 30A and 30B is arranged on the front face side of the printer 10, which is the side of the printer 10 that has the sheet S discharge opening 13, thus making it possible to easily operate the valve unit 52.

Note that the above-described embodiments may be modified to obtain other embodiments such as the following.

- In the fourth embodiment, the valve unit 52 may be arranged on the side face of the tank case 40 that extends along the sheet S conveying direction X.
- In the above embodiments, the flow channel cross-sectional area of the tube 34A connected to the ink tank 30A and the flow channel cross-sectional area of the tubes 34B to 34D connected to the ink tanks 30B to 30D may be the same as each other, or the flow channel cross-sectional area of the tube 34A may be smaller than the flow channel cross-sectional area of the tube 34B.
- In the third embodiment, a configuration is possible in which the window portions 42 are not provided in the side face of the tank case 40 that extends along the sheet S conveying direction X, and a window portion is provided in the front face of the tank case 40 that faces the sheet S conveying direction X. In this case, the ink tank 30A is configured such that the state of the ink inside it can be viewed through the front face, which is a side face that does not have the largest area among the outward-facing side faces.
- In the fourth embodiment, a configuration is possible in which the window portion 50 is not provided in the side face of the tank case 40 that extends along the sheet S conveying direction X. In this case, the ink tank 30A is configured such that the state of the ink inside it can be viewed through the front face, which is a side face that does not have the largest area among the outward-facing side faces.
- In the third and fourth embodiments, the ink tanks 30A to 30D may be configured such that the state of the ink inside them cannot be viewed due to being constituted by a non-transparent material. Also, the tank cases 40 and 41 may be configured such that the state of the ink inside the ink tanks 30A to 30D cannot be viewed due to having a configuration in which the window portions 42, 50, 51, and 55 are not provided.
- In the second embodiment, the ink tank 30B for storing cyan ink may be arranged in the first space S1 in the casing 11. In this case, the ink tank 30B may be arranged on the side opposite to the conveying region R2 across the ink tank 30A in the main scanning direction Z. Also, the ink tank 30B may be arranged on the conveying region R2 side relative to the ink tank 30A in the main scanning direction Z. In this configuration, the ink tank 30B, which is one of the ink tanks 30B to 30D that are examples of second liquid storage portions, is arranged between the sheet S conveying region R2 and the ink tank 30A, which is an example of a first liquid storage portion on one side located across the sheet S conveying region R2 in the casing 11. On the other hand, both of the other ink tanks 30C and 30D among the ink tanks 30B to 30D that are examples of second liquid storage portions are arranged on the other side located across the sheet S conveying region R2 in the casing 11.

In the second embodiment, the ink tanks 30A to 30D may be mounted to the outside of the casing 11.

In the fourth embodiment, the ink tank 30B may be arranged on the side opposite to the sheet S conveying region R2 located across the ink tank 30A in the main scanning direction Z.

In the first, third, and fourth embodiments, all of the ink tanks for storing the colors of ink other than black may be arranged on the side opposite to the ink tank for storing black ink across the sheet S conveying region R2 in the main scanning direction Z. In this case, the number of ink tanks for storing colors of ink other than black may be two, or three or more.

In the second embodiment, the number of ink tanks that are for storing colors of ink other than black and are arranged at positions on the side opposite to the ink tank for storing black ink across the sheet S conveying region R2 in the main scanning direction Z may be two, or four or more.

In the above embodiments, the volume of the ink tank 30A for storing black ink and the volume of the ink tanks 30B to 30D for storing the colors of ink other than black may be the same as each other.

In the above embodiments, the ink tank 30A may store ink other than black ink, such as metallic ink. Also, the ink tanks 30B to 30D may store black ink.

In the above embodiments, the medium is not limited to being the sheet S, and the medium may be a plastic film, a plate-shaped material, or the like. Alternatively, the medium may be a fabric used in a textile printing device.

In the above embodiments, the liquid ejection device may be a liquid ejection device that ejects or discharges a liquid other than ink. Note that examples of the state of liquid that is discharged as minuscule droplets from the liquid ejection device include a granular shape, a teardrop shape, and a shape having a thread-like trailing end. Also, the liquid referred to here need only be a material that can be ejected from the liquid ejection device. For example, the liquid need only be a material whose substance is in the liquid phase, and the liquid here encompasses high or low viscosity liquid materials, as wells a liquid materials such as sols, gel water, other inorganic solvents, organic solvents, solutions, liquid resins, and liquid metals (metal melts). Also, the liquid is not limited to being a single-state substance, and the liquid here encompasses a substance in which functional material particles made of a solid substance such as pigment or metal particles are dissolved, dispersed, or mixed in a solvent. Other representative examples of liquids include liquid crystal and ink such as that described in the above embodiments. Here, the term ink encompasses general water-based ink and oil-based ink, as well as various types of liquid compositions such as gel ink and hot-melt ink. Specific examples of the liquid ejection device include liquid ejection devices that eject a liquid containing dispersed or dissolved materials such as electrode materials or coloring material used for producing liquid crystal displays, EL (Electro Luminescence) displays, field emission displays, color filters, and the like. Other examples include liquid ejection devices that eject bioorganic materials used to manufacture biochips, liquid ejection devices that are used as precision pipettes and eject a liquid serving as a specimen, textile printing devices, micro-dispensers, and the like. Further examples include liquid ejection devices that eject lubricating oil for pinpoint application onto precision machines such as watches or cameras, and liquid ejection devices that eject transparent resin liquid such as ultraviolet curing resin onto a substrate in order to form minute hemispherical lenses (optical lenses) used for optical communications devices or the like. Another example is liquid ejection devices that eject acidic or alkaline etching liquid in order to perform etching on a substrate or the like.

What is claimed is:

1. A liquid ejection device comprising:

a liquid ejection portion that ejects a liquid onto a medium;

a liquid storage portion that stores the liquid to be supplied to the liquid ejection portion; and a flow channel that connects the liquid storage portion and the liquid ejection portion, wherein the liquid storage portion is configured so as to include a first liquid storage portion and a second liquid storage portion, the first liquid storage portion including a liquid injection opening that receives injection of the liquid, the second liquid storage portion including a liquid injection opening that receives injection of the liquid the first liquid storage portion and the second liquid storage portion are respectively arranged on one side and another side lateral to a medium conveying region, the first liquid storage portion and the second liquid storage portion being aligned across the medium conveying region, and the first liquid storage portion having a number of tanks that is different than a number of tanks of the second liquid storage portion.

2. The liquid ejection device according to claim 1, wherein a liquid storing capacity of the first liquid storage portion is greater than that of the second liquid storage portion.

3. The liquid ejection device according to claim 2, wherein the liquid storage portion is configured so as to include a plurality of the second liquid storage portions, and the plurality of second liquid storage portions are arranged side-by-side in a medium conveying direction.

4. The liquid ejection device according to claim 3, wherein the plurality of second liquid storage portions are provided with a viewing portion that enables viewing of a state of the ink inside the second liquid storage portions on a side face that extends along an alignment direction of the second liquid storage portions.

5. The liquid ejection device according to claim 2, wherein the liquid storage portion is configured so as to include a plurality of the second liquid storage portions, and the plurality of second liquid storage portions are arranged side-by-side in a direction orthogonal to a medium conveying direction.

6. The liquid ejection device according to claim 5, wherein the plurality of second liquid storage portions are provided with a viewing portion that enables viewing of a state of the ink inside the second liquid storage portions on a side face that extends along an alignment direction of the second liquid storage portions.

7. The liquid ejection device according to claim 5, wherein the plurality of second liquid storage portions include respective liquid injection openings arranged in the direction orthogonal to the medium conveying direction.

8. The liquid ejection device according to claim 2, wherein the first liquid storage portion is arranged such that a lengthwise direction thereof conforms to a medium conveying direction, the liquid storage portion is configured so as to include a plurality of the second liquid storage portions, and among the plurality of second liquid storage portions, a portion of the second liquid storage portions are arranged between the medium conveying region and the first liquid storage portion on the one side located across the medium conveying region, and at least another portion of the second liquid storage portions are arranged on the other side located across the medium conveying region.

9. The liquid ejection device according to claim 2, wherein the first liquid storage portion is provided with a viewing portion that enables viewing of a state of the ink inside the first liquid storage portion on a side face that has a largest area among outward-facing side faces.

10. The liquid ejection device according to claim 2, wherein a cross-sectional area of the flow channel connected to the first liquid storage portion is larger than a cross-sectional area of the flow channel connected to the second liquid storage portion.

11. The liquid ejection device according to claim 1, wherein a valve unit for opening and closing the flow channel is arranged on a side face of the liquid storage portion that faces a medium conveying direction.

12. The liquid ejection device according to claim 1, wherein the first liquid storage portion stores black ink as the liquid, and the second liquid storage portion stores a color of ink other than black as the liquid.

13. The liquid ejection device according to claim 1, wherein the liquid storage portion is provided inside a casing that constitutes the exterior of the liquid ejection device.

14. The liquid ejection device according to claim 1, wherein the first liquid storage portion and the second liquid storage portion are stationary and are not moved across the medium conveying region.

15. The liquid ejection device according to claim 1, wherein the liquid storage portion further includes an atmosphere communication opening, the liquid injection opening is positioned closer to a front face of the liquid ejection device than the atmosphere communication opening.

16. The liquid ejection device according to claim 1, wherein the first liquid storage portion having a number of tanks that is less than a number of tanks of the second liquid storage portion.

17. The liquid ejection device according to claim 1, further comprising an operation panel, wherein the first liquid storage portion and the second liquid storage portion are respectively arranged on one side and another side lateral to the operation panel.

18. A liquid ejection device comprising:

a liquid ejection portion that ejects a liquid onto a medium;

a liquid storage portion that stores the liquid to be supplied to the liquid ejection portion; and a flow channel that connects the liquid storage portion and the liquid ejection portion, wherein the liquid storage portion is configured so as to include a first liquid storage portion and a second liquid storage portion, the first liquid storage portion and the second liquid storage portion are respectively arranged on one side and another side lateral to a medium conveying region, the first liquid storage portion and the second liquid storage portion being aligned across the medium conveying region, the first liquid storage portion having a number of tanks that is less than a number of tanks of the second liquid storage portion, a liquid storing capacity of the first liquid storage portion is greater than that of the second liquid storage portion, and the first liquid storage portion contains a different type of ink that from that contained in the second liquid storage portion.

19. The liquid ejection device according to claim 18, wherein the liquid storage portion is configured so as to include a plurality of the second liquid storage portions, and the plurality of second liquid storage portions are arranged side-by-side in a medium conveying direction.

20. The liquid ejection device according to claim 19, wherein the plurality of second liquid storage portions are provided with a viewing portion that enables viewing of a state of the ink inside the second liquid storage portions on a side face that extends along an alignment direction of the second liquid storage portions.

21. The liquid ejection device according to claim 18, wherein the liquid storage portion is configured so as to include a plurality of the second liquid storage portions, and the plurality of second liquid storage portions are arranged side-by-side in a direction orthogonal to a medium conveying direction.

22. The liquid ejection device according to claim 21, wherein the plurality of second liquid storage portions are provided with a viewing portion that enables viewing of a state of the ink inside the second liquid storage portions on a side face that extends along an alignment direction of the second liquid storage portions.

23. The liquid ejection device according to claim 18, wherein the first liquid storage portion is provided with a viewing portion that enables viewing of a state of the ink inside the first liquid storage portion on a side face.

24. The liquid ejection device according to claim 18, wherein a cross-sectional area of the flow channel connected to the first liquid storage portion is larger than a cross-sectional area of the flow channel connected to the second liquid storage portion.

25. The liquid ejection device according to claim 18, wherein the liquid storage portion further includes an atmosphere communication opening, the liquid injection opening is positioned closer to a front face of the liquid ejection device than the atmosphere communication opening.

26. The liquid ejection device according to claim 18, further comprising an operation panel, wherein the first liquid storage portion and the second liquid storage portion are respectively arranged on one side and another side lateral to the operation panel.

* * * * *